United States Patent [19]

Weiller

[11] 4,448,314

[45] May 15, 1984

[54] MERCHANDISE RACK

[75] Inventor: Peter J. Weiller, Armonk, N.Y.

[73] Assignee: Thomson Leeds Company, Inc., New York, N.Y.

[21] Appl. No.: 388,458

[22] Filed: Jun. 14, 1982

[51] Int. Cl.[3] ..... A47F 5/02

[52] U.S. Cl. ..... 211/131; 211/43; 211/163; 211/184

[58] Field of Search ..... 211/163, 41, 42, 43, 211/78, 131, 133, 128, 129, 205, 184, 144

[56] References Cited

U.S. PATENT DOCUMENTS

| | | | |
|---|---|---|---|
| 4,079,841 | 3/1978 | Castel | 211/163 X |
| 4,099,627 | 7/1978 | Strada | 211/163 |
| 4,247,010 | 1/1981 | Eckert | 211/163 X |
| 4,296,866 | 10/1981 | Learnard | 211/131 |

FOREIGN PATENT DOCUMENTS

| | | | |
|---|---|---|---|
| 1562972 | 3/1969 | France | 211/184 |
| 597795 | 11/1977 | Switzerland | 211/184 |
| 456322 | 11/1936 | United Kingdom | 211/184 |

*Primary Examiner*—Ramon S. Britts
*Assistant Examiner*—Blair M. Johnson
*Attorney, Agent, or Firm*—Howard C. Miskin

[57] ABSTRACT

A book and magazine display rack includes a rotatable vertical hollow square shaft having vertically spaced pairs of transversely aligned openings engaged by respective positioning bars. A rack member rests on each bar and rotates with the shaft and includes an upwardly directed rectangular projection and downwardly outwardly inclined base walls extending from the projection bottom edges and terminating in upwardly directed peripheral walls. A transverse vertical partition wall abuts each projection end wall and includes bottom depending tabs engaging slots in the base wall and an inwardly directed projection having a depending tab engaging a slot in the central projection top wall. A rectangular wire frame has legs above the peripheral walls and one pair of frame opposite legs engages recesses in the partition walls and has stops engaging the walls. A coupling section with a square coupling opening aligned with a similar opening in the top wall registers with the projection bottom opening and is tab and slot locked therein, the shaft engaging the square openings with the coupling section resting on a respective bar.

14 Claims, 7 Drawing Figures

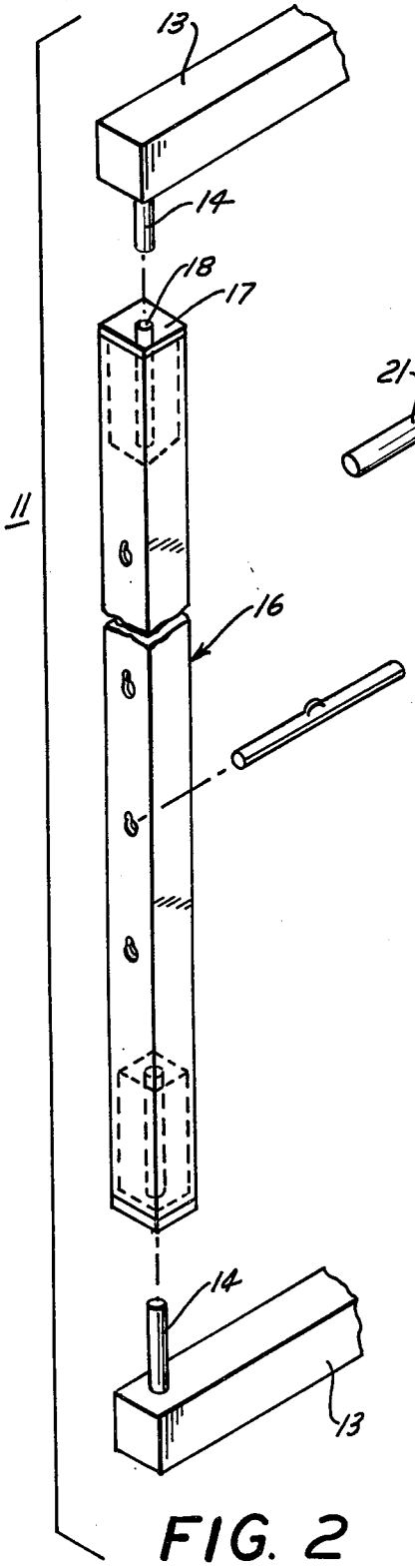
FIG. 2
FIG. 2A
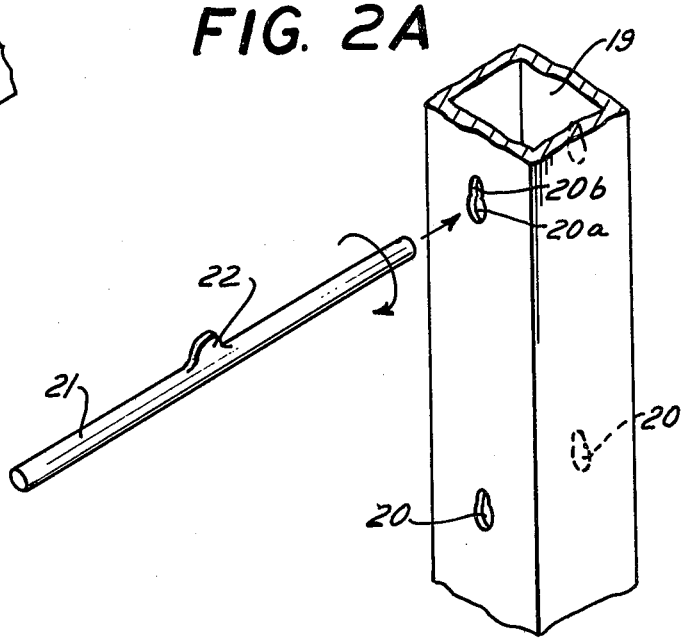
FIG. 2B
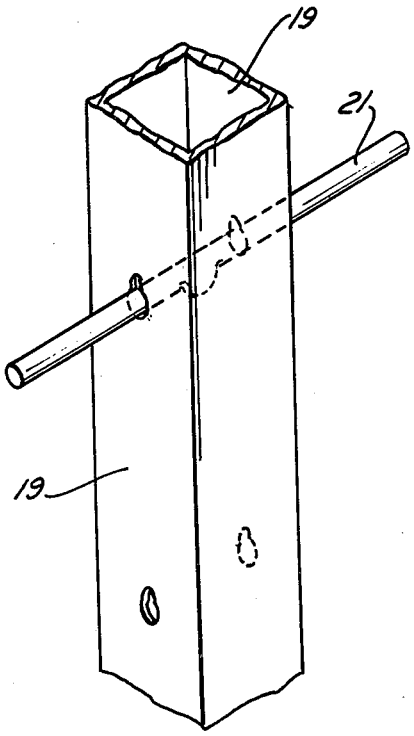

MERCHANDISE RACK

BACKGROUND OF THE INVENTION

The present invention relates generally to improvements in display structures and it relates more particularly to an improved structure for displaying and dispensing magazines, books, pamphlets, recordings of various types, and the like.

In the merchandising and dispensing of such articles as magazines, pamphlets, books, recordings and the like it is a common practice to stack groups of these articles in racks where they are displayed for visual rapid inspection and from which individual articles may be selected and removed. In order to display and provide selected access to a maximum number of articles within minimum of space it has been heretofore proposed to position sets of vertically spaced racks on respective suitably supported shafts so that the individual sets of racks are rotatable to provide access to different sections thereof. However, the rotatable rack structures heretofore proposed or available possess numerous drawbacks and disadvantages. They are bulky, expensive and inconvenient devices which are difficult to storage, ship and assemble and otherwise leave much to be desired.

SUMMARY OF THE INVENTION

It is a principal object of the present invention to provide an improved display and dispensing structure.

Another object of the present invention is to provide an improved device for displaying and dispensing magazines, booklets, books, pamphlets, greeting cards, recordings of various types and the like.

Still another object of the present invention is to provide an improved rotary type magazine and book rack.

A further object of the present invention is to porvide an improved structure of the above nature characterized by its ruggedness, reliability, convenience of use, low space requirements, ease of assembly and high versitility and adaptability.

The above and other objects of the present invention will become apparent from a reading of the following description taken in conjunction with the accompanying drawings which illustrate a preferred embodiment thereof.

A display structure according to the present invention includes a vertical shaft; a rack member including a body member having a coupling opening engaging the shaft, a pair of upstanding opposite walls coupled to the body member and a frame member including a first pair of opposite legs extending between and beyond and engaging the opposite edges of the partition walls and a second pair of opposite legs disposed outwardly of the partition walls; and means for supporting the rack member along the shaft.

In accordance with a preferred embodiment of the present invention the shaft is hollow and of square cross section and is vertically supported for rotation about its axis and supports a plurality of vertically spaced rack members by means of support rods separably rotatably engaging respective pairs of transversely aligned inverse key hole openings, each of the rods including an integral tab urging the rod to a locked position in the openings. A rack member is supported on each rod and the rack body member is rectangular and includes an open bottomed hollow upwardly directed central projection including top, end and front and rear walls, the top wall having a square central opening engaging the shaft and end coupling slots. Downwardly outwardly inclined base walls extend from the bottom edges of the central projection walls and terminate in upwardly directed peripheral walls. The partition walls have depending tabs which engage coupling slots in the end base walls and abut the central projection end walls and have inwardly directed hollow projections resting on the central projection and having tabs engaging the top wall coupling slots. The frame is rectangular and formed of wire and has legs disposed above the base peripheral wall, one pair of opposite legs engaging recesses in the edges of the partition walls and having integral stops engaging faces of the partition walls to restrict the lateral movement of the frame. A coupling section having a shaft coupling opening coaxial with that in the central projection top wall centrally registers with the central projection bottom opening and is affixed therein by tabs projecting from the coupling section and engaging coupling slots medially located in the bottom borders of the central projection front and rear wall.

The improved rack structure is simple, reliable and inexpensive, highly efficient in its space requirements; easy and convenient to use and simple to assemble without the need for tools and is of great versitility and adaptability.

BRIEF DESCRIPTION OF THE DRAWINGS

FIG. 2 is an exploded perspective view, partially fragmented of a support shaft for the rack member of FIG. 1;

FIG. 2A is an enlarged fragmentary perspective view of the support shaft and a positioning bar in separated positions;

FIG. 2B is a view similar to FIG. 2A but showing the shaft and bar in assembled condition;

DESCRIPTION OF THE PREFERRED EMBODIMENT

Figure 1:
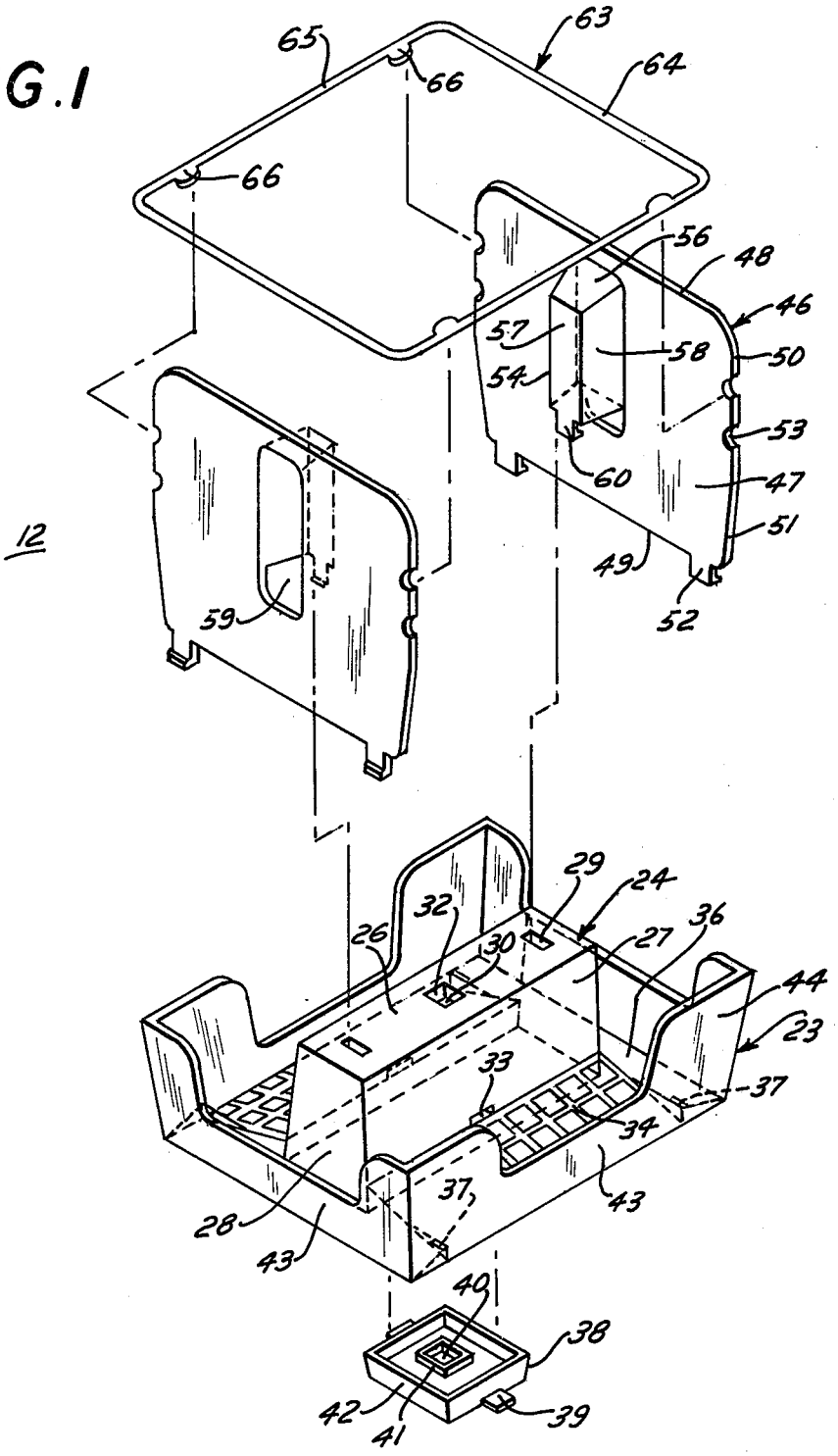
FIG. 1 is an exploded perspective view of a book rack member in accordance with the present invention.
Figure 3:
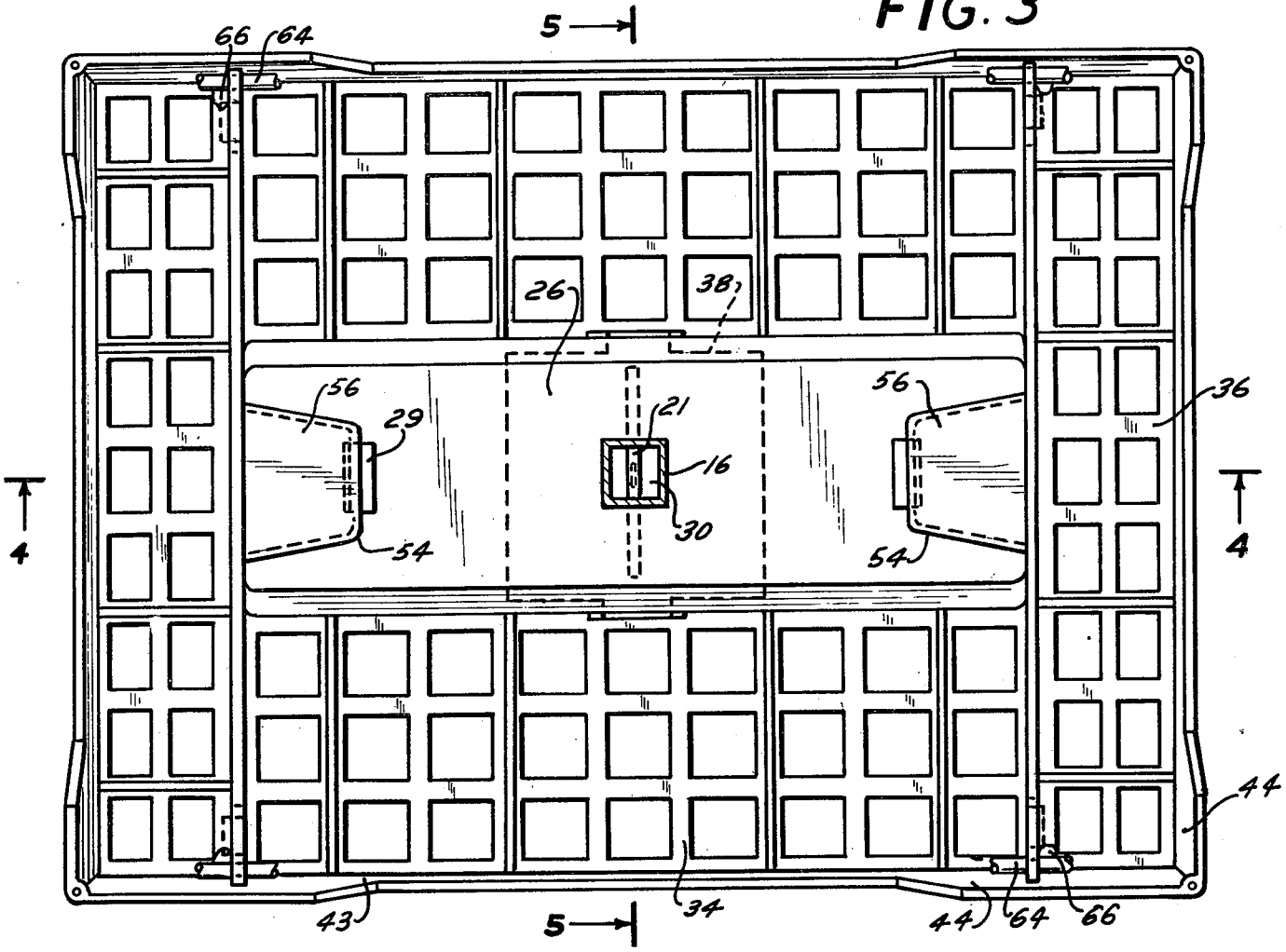
FIG. 3 is a top plan view of the assembled rack member mounted on the support shaft.

Referring to the drawings which illustrate a preferred embodiment of the present invention, the reference number 10 generally designates the improved device as applied to the display and ispensing of books or magazines or the like. The device 10 comprises a support structure 11 on which are mounted one or more rack units 12. The support structure 11 is preferrably formed of suitable metals such as steel or aluminum and the rack units are for the most part injection or otherwise formed of a suitable synthetic organic polymeric resin such as, for example, a high impact polystyrene.

The support structure 11 includes pairs of vertically spaced horizontal bars 13 which are suitably mounted and may project radially from the top and bottom of a main central post, not shown, or may be otherwise mounted. The posts 13 of each pair are provided proximate their outer ends with coaxial pivot pins 14 which are directed toward each other. A hollow shaft 16 of square or other polygonal transverse cross section its closed at its opposite ends with firmly affixed telescoping plug members 17 enlarged at their outer ends to the perimeter of shaft 16. Coaxial central vertical bores 18 are formed in the plugs 17 and are engaged by respective pivot pins 14 so that each shaft 16 extends between and is rotatably supported between the bars 13 of a respective pair.

Formed in a pair of opposite parallel walls 19 of shaft 16 are a plurality of equally vertically spaced pairs of medially disposed transversely aligned coupling openings 20, at least one of each pair being of inverse keyhole configuration including circular lower section **20*a* medially joined at its top by a slot upper section 20*b*. In the assembled device 10*a* support rod 21 of slightly less diameter than the coupling opening circular section 20*a* extends transversely between and beyond the coupling openings 20 of each pair to provide outwardly projecting arms. Medially disposed and integrally formed with rod 21 is a radially projecting tongue of a length slightly less than opening section 20*b* so that the rod 21 may be inserted in a pair of openings 20 with the tongue 22 being held vertically upwardly to traverse a slot section 20*b* and the rod 21 then released and permitted to rotate under the influence of the weight of tongue 22 until the tongue 22 depends from rod 21 to releasably lock the rod to shaft 16. The rod 21 may be finger rotated to bring tongue 22 to its desired position for locking or releasing the rod from shaft 16**.

Each of the rack units 12 comprises an integrally formed main body member 23 having an upwardly directed open bottomed central portion 24 of rectangular transverse cross section including a rectangular horizontal top wall 26, similar upwardly inwardly inclined front and rear walls 27 and similar trapezoidal upwardly slightly inwardly inclined end walls 28. Formed in top wall 26 proximate the ends thereof are a pair of medially located transverse coupling slots 29 and a square coupling opening 30 is centrally located in top wall 26 and is of about the dimensions of the cross section of shaft 16. Skirt walls 32 depend from the peripheral edges of opening 30. A pair of transversely aligned coupling slots 33 are formed in front and rear walls 27 along their bottom edges.

Figure 4:
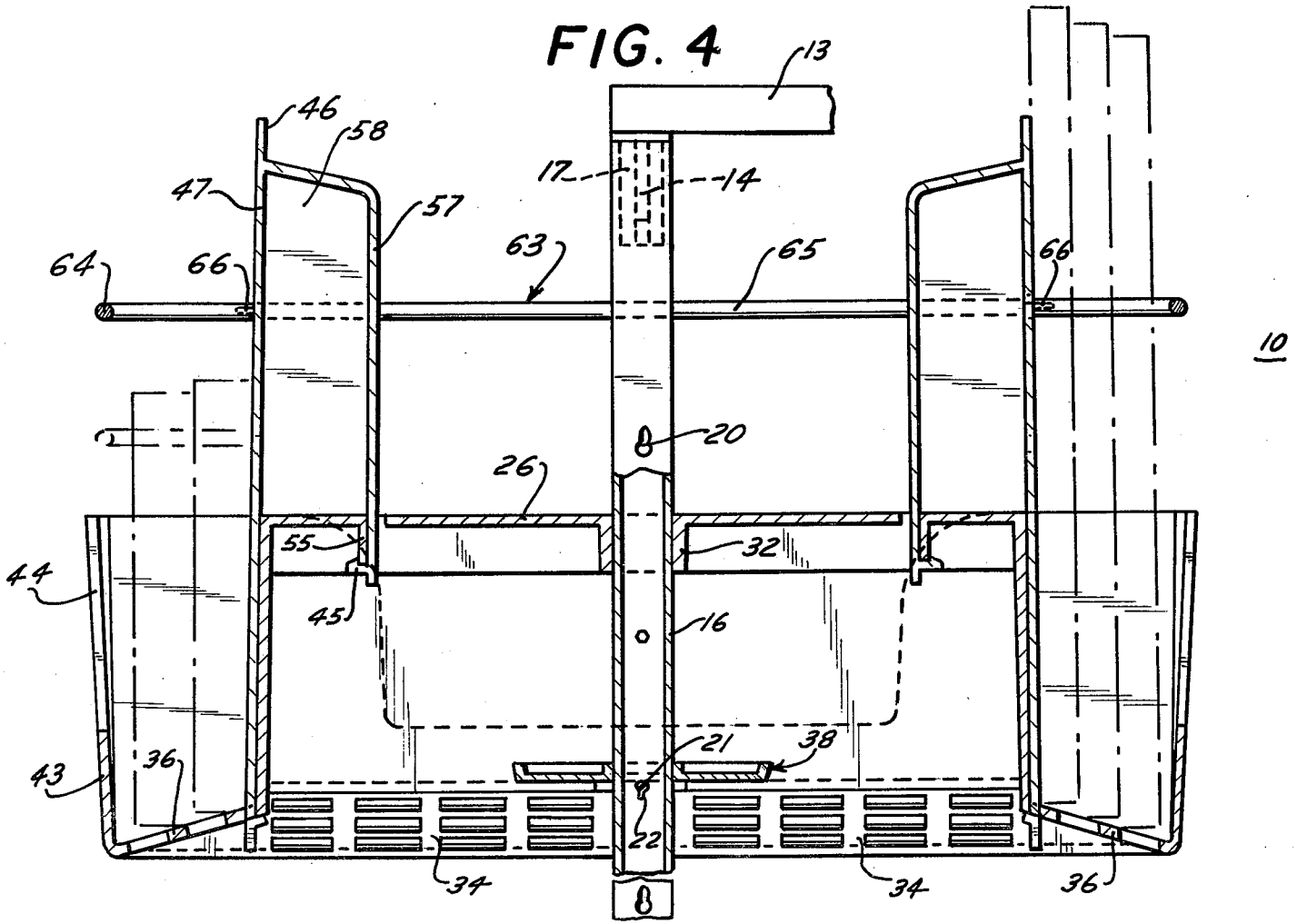
FIG. 4 is a sectional view taken along line 4—4 in FIG. 3.
Figure 5:
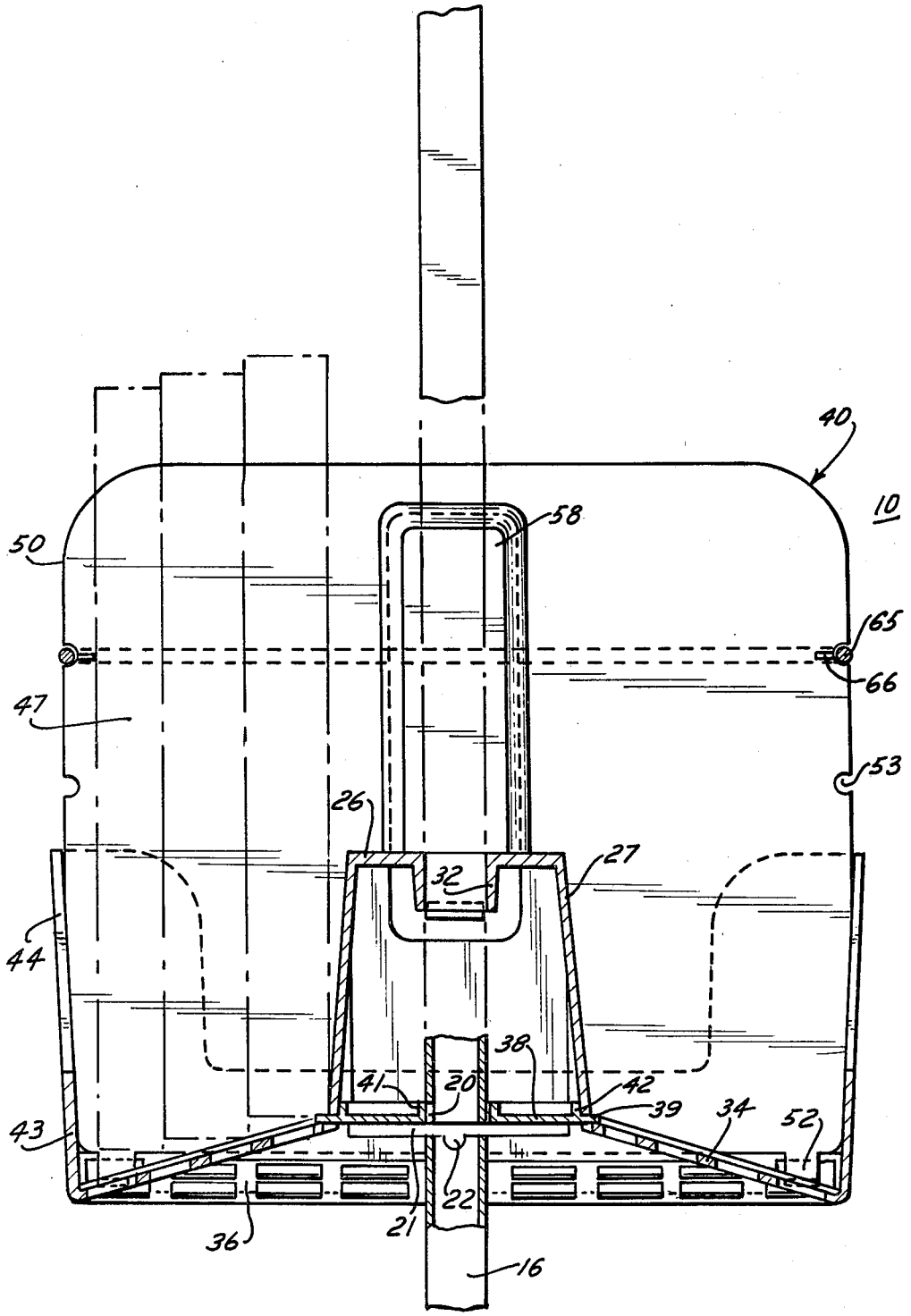
FIG. 5 is a sectional view taken along line 5—5 in FIG. 3.

Extending outwardly from the bottom edges of walls 27 and coextensive therewith are downwardly outwardly inclined, rectangular open-work base walls 34 and extending outwardly from the bottom edges of end walls 28 are downwardly outwardly inclined open-work rectangular base walls 36, as shown in FIGS. 4 and 5 which extend between the outer edges of base walls 34. Formed in the opposite inside corners of each base wall 36 is a pair of transverse coupling slots 37. Projecting upwardly from the outer edges of base walls 34 and 36 are upwardly slightly outwardly inclined upstanding walls 43 the ends 44 of which are of greater heights than the medial portions and those along base walls 34 being longer than those along base walls 36.

A square shaped shaft coupling section 38 medially engages the bottom opening of central portion 24 and includes a pair of medial transversely projecting tongues or tabs 39 engaging respective coupling slots 33 to lock section 38 in position. Centrally formed in section 38 is a square opening 40 similar to and coaxial with opening 30 and surrounded by an upstanding peripheral wall 41. Projecting upwardly from the outer edges of section 38 are reinforcing peripheral walls 42.

A pair of upstanding partition or side walls 46 are coupled to body member 23 along end walls 28 and each includes a flat panel 47 having horizontal top and bottom edges 48 and 49 respectively and side edges including vertical upper sections 50 and slightly downwardly converging lower sections 51. Partition wall bottom edges 49 rest on the inner borders of base walls 36 and lower side edges edge sections 51 engage the confronting faces of the enlarged end portions 44 of front and rear peripheral walls 43. Depending from the side portions of wall bottom edge 49 are a pair of tongues 52 which engage corresponding coupling slots 37 in base walls 36 and terminate in enlarged heads.

Formed in each upper edge 50 of panels 47 is a pair of vertically spaced arcuate recesses or notches 53 of slightly greater than 180°, the upper and lower notches lying in respectively upper and lower horizontal planes. Projecting inwardly from each panel 47 at the upper portion thereof is a medially located hollow section 54 open at its outside face and at its bottom and including a top wall 56, a vertical rectangular inside wall 57 and side walls 58, extending between the vertical edges of the rectangular medial opening 59 formed in panel 47 and corresponding edges of wall 57. The bottom edges of walls 57 and 58 lie in a horizontal plane above the bottom of opening 59 and rest on central portion top wall 26. A tongue 60 medially depends from each inside wall 57 into engagement with a corresponding coupling slot 29 in top wall 26 and terminates in an enlarged head 45 underlying the wall 26 and engaging a flange 55 depending from wall 26 along a respective edge of slot 29.

A resilient metal wire rectangular frame 63 includes parallel end legs 64 and parallel front and rear legs 65 and engages partition walls 46 at selected horizontal levels corresponding to that of the upper or lower notches 53. The front and rear frame legs 65 snap engage selected respective coplanar notches 53 and are provided with integrally formed inwardly projecting stop defining circular tabs 66 which engage the outside faces of partition walls 46 to restrict the relative movement between the walls 46 and frame 63. In the assembled condition of rack unit 12, the frame legs 64 and 65 are coplanar and horizontal and are positioned above the upper edges of perpheral walls 43 and enlarged wall section 44 and are approximately in vertical alignment therewith.

It should be noted that the body members 23 may be compactly stacked as may the walls 46 and other components to facilitate their storage and shipment. Moreover, the rack units 12 are easily and conveniently assembled without the need for special tools and are easily mounted on a shaft 16. In assembling the rack units and shaft a support pin 21 is merely inserted and locked in the lowermost pair of openings 20 as described above and an assembled rack unit is brought into engagement with the shaft through openings 30 and 40 and slid downwardly until section 38 rests on an underlying pin 21 and the procedure is repeated with successive pins 21 being inserted in successive pairs of openings 22 and successive pairs of openings 22 and successive rack units 12 brought into engagement with the shaft 16 and to rest on the immediate underlying pins 21. The rack unit carrying shaft is then coupled between coaxial pivot pins 14.

While there has been described and illustrated a preferred embodiment of the present invention it is apparent that numerous alterations, omissions and additions may be made without departing from the spirit thereof.

I claim:

1. A display structure comprising a vertical shaft;

A rack member including a body member having a first coupling opening engaging said shaft, a pair of opposite upstanding partition walls coupled to said body member and a frame member including a first pair of opposite legs extending between and beyond and engaging the opposite edges of said walls and a second pair of opposite legs disposed outwardly of said walls; and means for supporting said rack member at a predetermined position along said shaft.

2. The display structure of claim 1 wherein said shaft and said coupling opening are of polygonal transverse cross-section whereby said shaft and rack member are concurrently rotatable and further comprising means for vertically supporting said shaft for rotation about its vertical axis.

3. The display structure of claim 1 wherein said shaft is hollow and has a pair of transversely aligned openings formed therein and said supporting means comprises a bar extending between and engaging said openings and having means releasably retaining said bar in said openings said rack member resting on said bar.

4. The display structure of claim 3 wherein each of said openings includes a circular bottom section and a medial slot extending upwardly from said bottom section and said bar is of circular transverse cross section and includes a radially projecting tab passable with said bar through said opening with said tab being upwardly directed and said tab being rotatable with said bar to a tab depending position.

5. The display structure of claim 2 wherein said shaft has axial bores in the opposite ends thereof and said shaft supporting means comprises a pair of vertically spaced support members provided with coaxial pins directed toward each other and rotatably engaging said axial bores.

6. The display structure of claim 3 wherein said shaft has a plurality of vertically spaced pairs of said aligned openings formed therein engaged by respective bars, one of said rack members resting on each of said bars.

7. The display structure of claim 1 wherein said body member is of rectangular configuration and includes an upwardly projecting hollow central portion having a top wall and upwardly directed end walls and front and rear walls, and base walls extending outwardly from the lower borders of said central portion walls, said first coupling opening being formed in said top wall.

8. The display structure of claim 7 wherein said body member includes a coupling section registering with the bottom of and connected to said central portion and having a second coupling opening coaxial with said first coupling opening and engaging said shaft.

9. The display structure of claim 7 wherein said base walls are upwardly inwardly inclined.

10. The display structure of claim 9 wherein walls terminate at their outer edges in upwardly projecting peripheral walls.

11. The display structure of claim 7 wherein each of said base walls extending to said central portion end walls have a coupling slot therein proximate a respective end wall and each of said partition walls abuts a corresponding end wall and includes a depending tab engaging a respective coupling slot.

12. The display structure of claim 11 wherein each of said partition walls has an integrally formed projection extending inwardly from the upper portion thereof and resting on said top wall and having a depending tab engaging a corresponding coupling slot formed in said top wall.

13. The display structure of claim 1 wherein said partition walls have coplanar recesses formed in the opposite edges thereof and engaged by said frame member.

14. The display structure of claim 1 wherein said frame member has stop defining inwardly directed projections proximate said partition walls.

* * * * *